United States Patent [19]

Ischebeck et al.

[11] Patent Number: 4,752,157

[45] Date of Patent: Jun. 21, 1988

[54] TRENCH SHORING BOX UNIT

[75] Inventors: Ernst-Friedrich Ischebeck; Joachim Isenberg, both of Ennepetal, Fed. Rep. of Germany

[73] Assignee: Friedrich Ischebeck GmbH, Ennepetal, Fed. Rep. of Germany

[21] Appl. No.: 18,018

[22] Filed: Feb. 24, 1987

[30] Foreign Application Priority Data

Feb. 27, 1986 [DE] Fed. Rep. of Germany ... 8605280[U]

[51] Int. Cl.[4] ..... E02D 17/08

[52] U.S. Cl. ..... 405/282

[58] Field of Search ..... 405/282, 283, 272; 248/351, 357, 354.1, 354.3

[56] References Cited

U.S. PATENT DOCUMENTS 3,937,026 2/1976 Krings ..... 405/282

FOREIGN PATENT DOCUMENTS 537585 10/1931 Fed. Rep. of Germany ..... 405/282
1508801 1/1968 France ..... 405/282
2476170 8/1981 France ..... 405/282

*Primary Examiner*—David H. Corbin
*Attorney, Agent, or Firm*—Collard, Roe & Galgano

[57] ABSTRACT

A trench shoring box unit having hollow partition walls and internal support webs. The partition walls positioned spaced apart and facing each other and connected together by adjustable length braces. The partition walls are constructed of aluminum and have a tongue-and-groove joint formed on the longitudinal edges for interlocking with adjacent partition walls. The transverse edges of each partition wall tightly engages a recess formed on one side of shoe bars. A flange is formed on the other side of the shoe bar and projects outwardly beyond the surface of the partition wall along the transverse edge. The adjustable length braces are connected to the flanges.

12 Claims, 7 Drawing Sheets

E
Z
11
W
11
W
18
18
19
1
19
1'
1'
24
24
22
22
25
25
19
19
1'
1'
24
24
22
22
25
25
23

TRENCH SHORING BOX UNIT

BACKGROUND OF THE INVENTION

This invention relates to an improved trench shoring box unit. More particularly, it relates to a lightweight trench shoring unit that can readily be adapted to shore up the walls of trenches having a variety of dimensions.

A prior art trench shoring box unit is disclosed in German Patent Application No. 25 02 567, where the walls consist of a pair of steel plates facing each other and are connected together by U-section spacers. The legs of the U-section spacers are spot welded to the plates. Not only is this kind of trench shoring box unit heavy and bulky to handle, but it is costly to manufacture.

SUMMARY OF THE INVENTION

The novel trench shoring box unit disclosed in this invention comprises a plurality of identically shaped partition walls which may be assembled together to form any desired size of a shoring box. Each partition wall has tongue-and-groove joints formed along its longitudinal edges to interlock adjacent partition walls with each other. A flange is positioned along the transverse edges of each partition wall and extends outwardly from the surface of said partition wall. A partition wall on one trench wall faces the partition wall on the opposite trench wall and they are connected together by adjustable length braces, the ends of which engage the flanges at the transverse edges of each partition wall. The adjustable length braces are in the form of a turnbuckle wherein two reversely threaded end sections engage a threaded center section. The rotation of the center section in one direction causes the threaded end sections to move away from the center section thus increasing the total length of the brace. A reverse rotation of the center section will cause the end sections to move toward the center section thus reducing the length of the brace. When two or more partition walls are longitudinally assembled together, a coupling bar is secured to the flange and overlaps the joined edges of the flanges of the adjoining partition walls. The braces are thereafter secured to the coupling bars.

In accordance with the foregoing, an object of the invention is to provide a trench shoring box unit which has less weight than prior trench shoring systems.

Another object is to provide a trench shoring box unit which has a high degree of stability.

A still further object is to provide a trench shoring box unit that can be easily manufactured and assembled to meet the dimensional requirements of a trench.

SUMMARY OF THE INVENTION

According to the disclosed embodiment, the trench shoring box unit can be used many times and requires very little maintenance. Furthermore, having the partition walls made of aluminum has the advantage of reducing the weight while at the same time maintaining satisfactory stability. Because of the lighter weight, loading, unloading, as well as transporting of the partition walls can be done by hand. In addition, the partition walls may be assembled to make the size of the shoring box unit needed for the size of the trench. By the use of the groove-and-tongue joint, the interlocking of the individual partition walls, when forming a shoring box unit, is practically self centering. The assembled partition walls are held at the transverse edges by the shoe bars having lateral recesses and flanges extending outwardly from the surface of the partition walls for engaging braces which connect opposing partition walls. The pressure exerted by the braces thus acts on the flanges which in effect form a vertical strap along the transverse edges of the partition walls. The partition walls are preferably made from extruded hollow sections. A portion of the shoe bars form a cover for open ends of the hollow spaces, so that soil or similar material cannot infiltrate and increase the weight of such partition walls. The disclosed construction provides for an optimum interrelation of forces by having the flanges overlap the partition wall surface in such a way that the prolongation of the axis of the braces crosses the partition wall. When the partition walls are assembled, one over the other, the pressure load is distributed over the head sections of the partition walls. The preferred interlocking of adjacent partition walls is achieved by a groove-and-tongue joint which, in cross-section, is a "V"-shaped configuration with the apex of the "V" lying in the longitudinal centerplane of the partition wall. This construction of the groove-and-tongue joint increases the area of the joint and thereby provides a larger support area for the coupled partition walls. The tilt of the "V" shape extends to the inner surface of the partition walls and from that point a support shoulder e tends from the inner surface to the outer surface. In this way, looking in a vertical direction, the upper partition wall rests on the lower portition wall. This provides an improved stability for the assembled partition walls. For example, the pounding of a dredger bucket creates a pressure load on the walls in a direction that requires stability of the assembled partition walls. The inner support webs lying at right angles to the walls of each partition wall remain practically unstressed by such pressure load.

Other objects and features of the present invention will become apparent from the following detailed description considered in connection with the accompanying drawings. It is to be understood, however, that the drawings are designed for the purpose of illustration only and not as a definition of the limits of the invention.

DESCRIPTION OF THE DRAWINGS

In the drawings, wherein similar reference characters denote similar elements throughout the several views.

DETAILED DESCRIPTION OF THE PREFERRED EMBODIMENT

Figure 1:
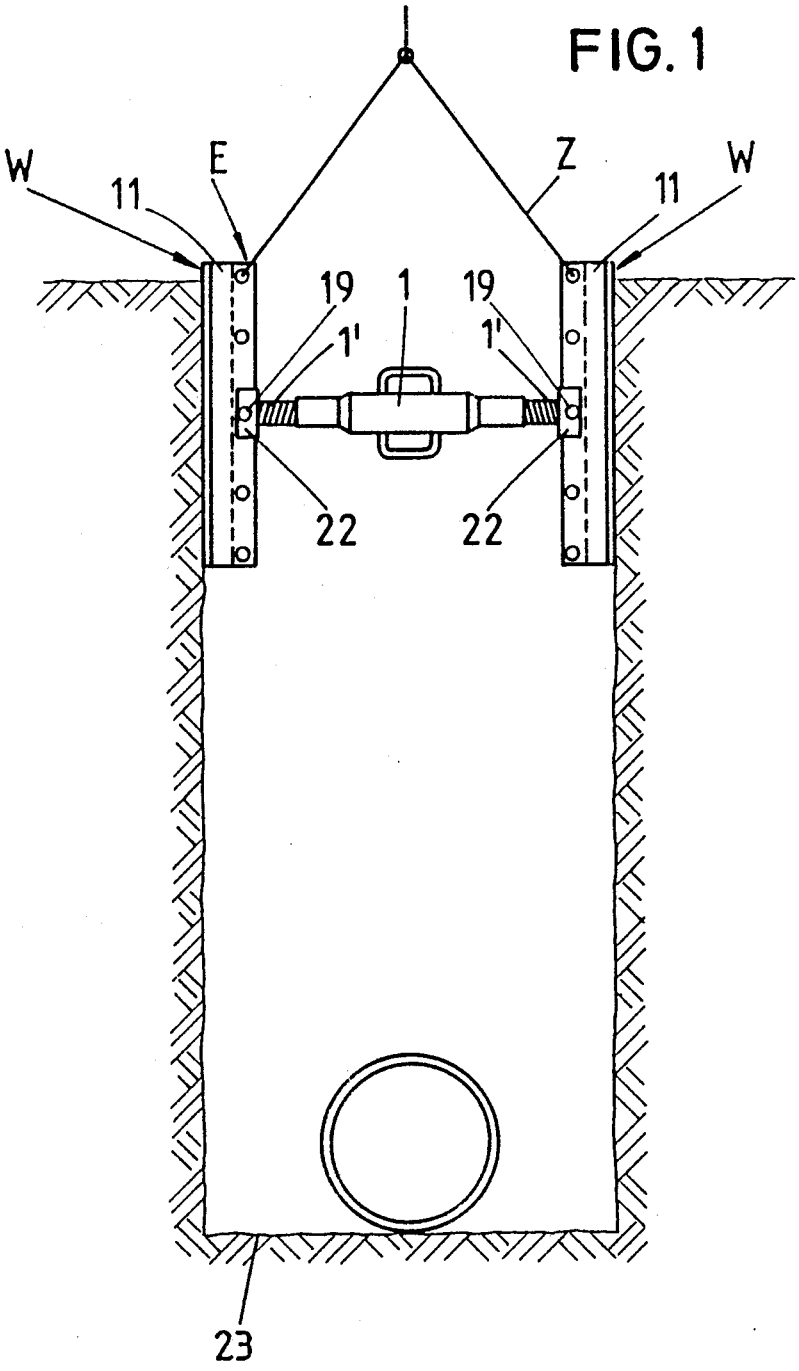
FIG. 1 is a side elevation view of a trench shoring box unit, according to the invention, being used for edge shoring of a trench, the trench being shown in section.
Figure 2:
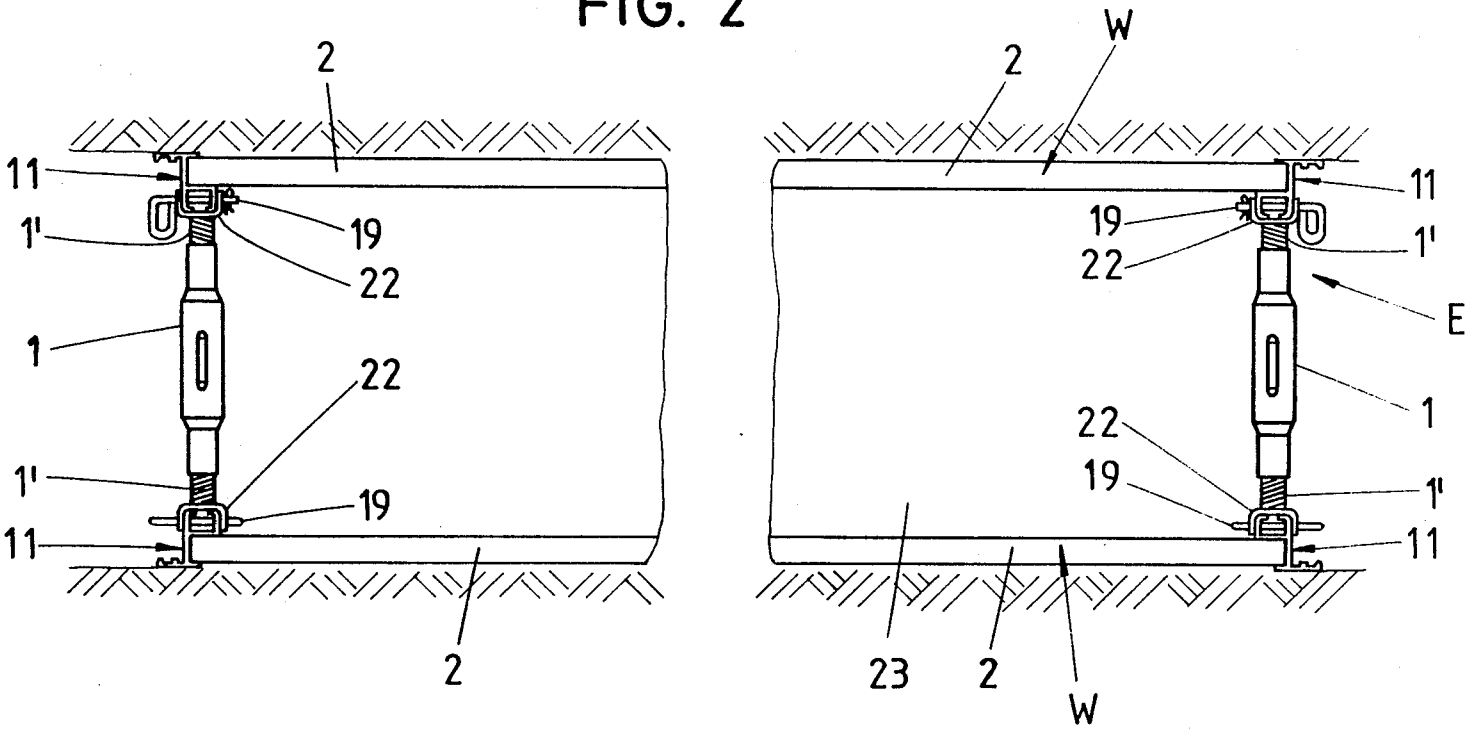
FIG. 2 is a top plan view of the trench shoring box unit shown in FIG. 1.

The preferred embodiment, as shown in FIG. 1, comprises a trench shoring box unit E of a light aluminum which provides a shoring system for gas and water pipelines having two identically constructed walls W which are connected by end braces 1 and, optionally, by diagonal guy wires, chains or similar means (not shown). The unit E is shown hanging in a wire sling Z for insertion into and extraction from a trench.

Figure 6:
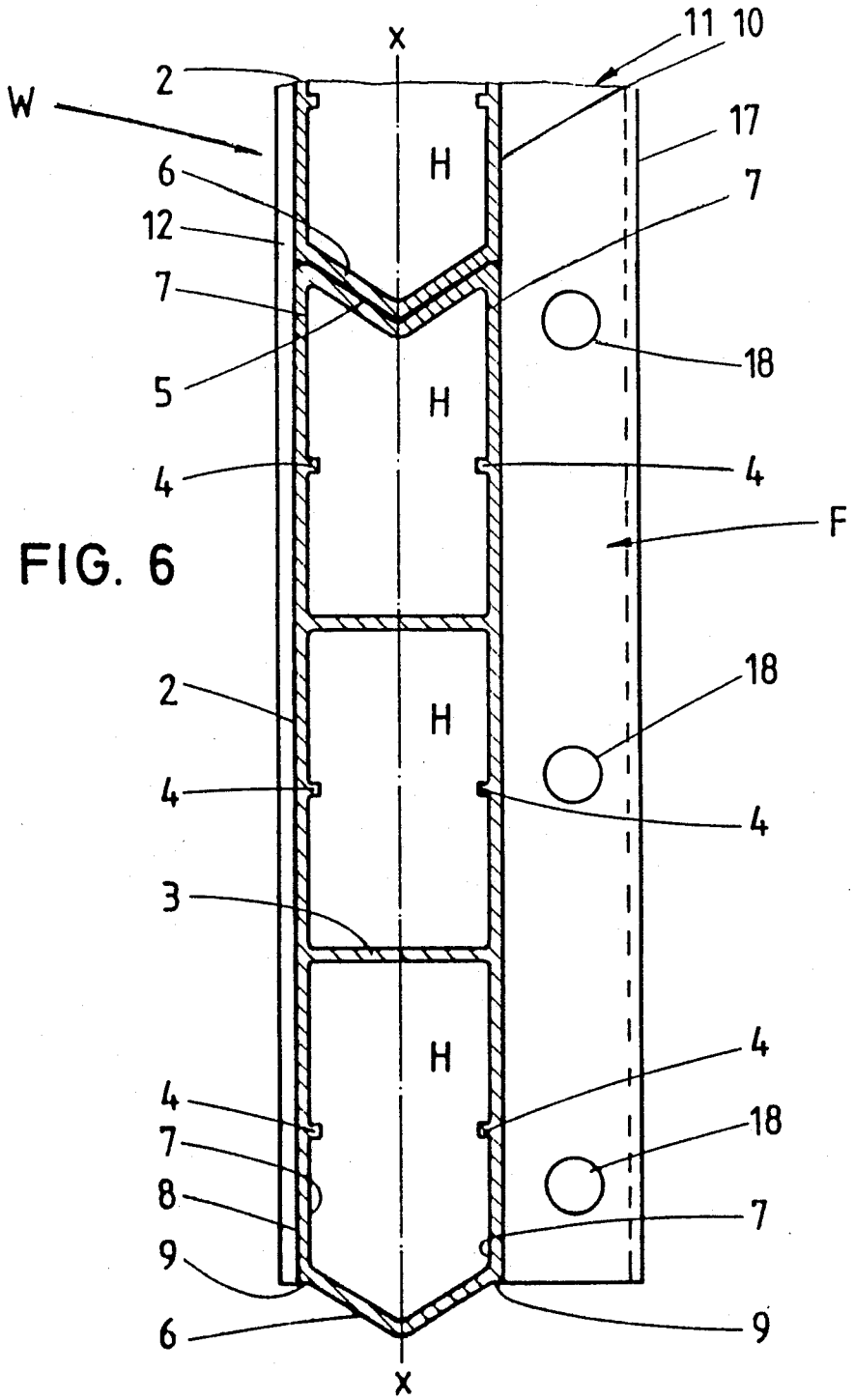
FIG. 6 is an enlarged sectional view taken along line VI—VI of FIG. 4.
Figure 7:
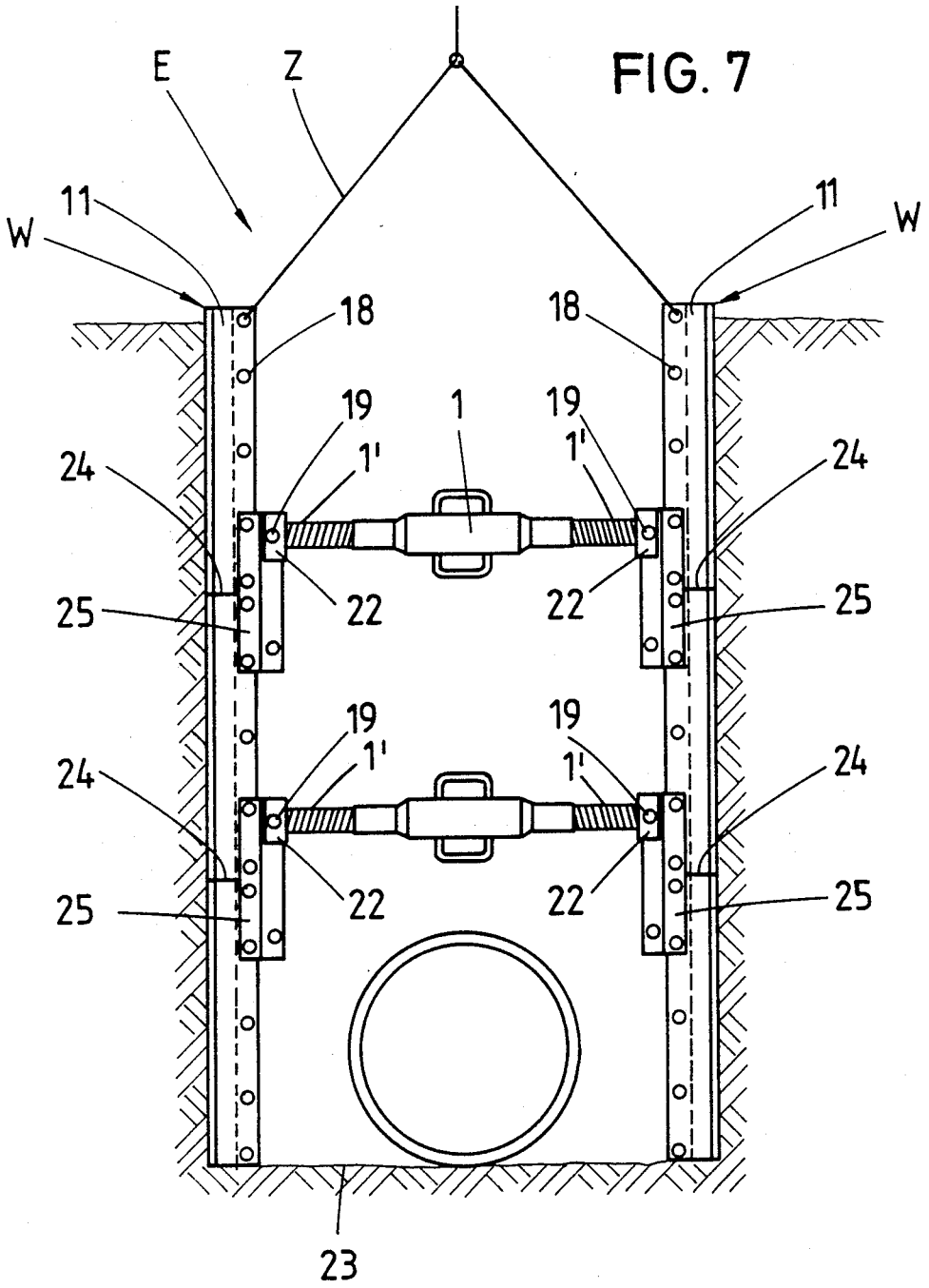
FIG. 7 is a side elevation view of a trench shoring box unit showing several partition walls joined together to extend throughout the depth of the trench, the trench being shown in section.

As shown in FIG. 7, each of the walls W consists of several identical partition walls 2 arranged one above another. The preferred embodiment for the partition walls comprises crosscut sections from a flat extruded aluminum box section. As seen in FIG. 6, the crosscut section has parallel wall sections 8 which are connected with one another through integrally formed support webs 3 inside the box section. The box section is configured in such a way that vertical hollow spaces H of about the same size are adjoining each other. About halfway between the support webs 3, short longitudinal ribs 4 are formed on the inside surface 7 of the wall sections and extend inwardly perpendicular to surface 7, thus providing additional stiffness to the partition wall.

The longitudinal edges of the partition walls 2 form a groove 5 on one side and a tongue 6 on the other side. Groove 5 and tongue 6 in addition to providing an interlocking joint for adjacent partition walls, also provides an upper and lower closure for the corresponding hollow spaces H. The cross sections have a "V"-shape configuration with the apex of the "V" lying in the longitudinal center plane x-x of the partition wall. The thickness of the webs forming groove 5 and tongue 6 are the same as the thickness of support webs 3 and the partition walls.

From FIG. 6, it can be further seen that the pitch of the "V" forming groove 5 and tongue 6 extends to the inner surfaces 7 of the wall sections of partition walls 2. A horizontal support shoulder 9 extends perpendicularly to the outer surfaces 8 from the point where groove 5 and tongue 6 join inner surface 7 of the section walls. Support shoulders 9 extend over the entire length of partition walls 2. Support shoulders 9 orient the adjoining partition walls 2 so that they are perpendicular to the longitudinal center plane x-x of each partition wall so that wall section rests upon wall section.

The vertical transverse edges of the partition walls 2 tightly engaged within a recess 10 of the shoe bars 11. Recess 10 extends the entire length of the vertical transverse edge of partition walls 2 and closes off the open ends of the hollow spaces H in the form of a cover to prevent infiltration of soil or moisture. The shoe bars are secured in place by welding. Recesses 10 only extend to the support shoulder 9 at the tongue side 6 of the longitudinal edges of the partition wall.

Figure 3:
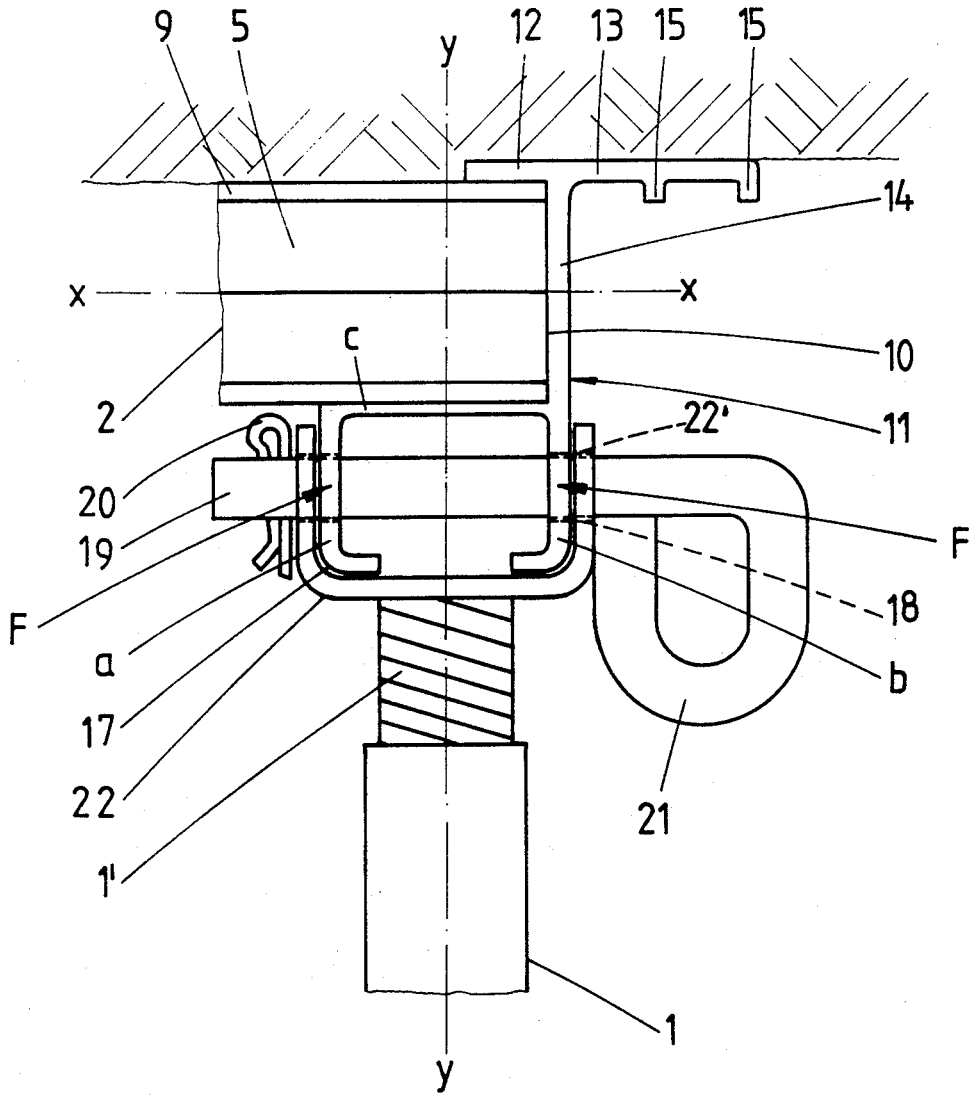
FIG. 3 is an enlarged top plan view of one of the connections between a brace and a partition wall, as shown in FIG. 2.
Figure 4:
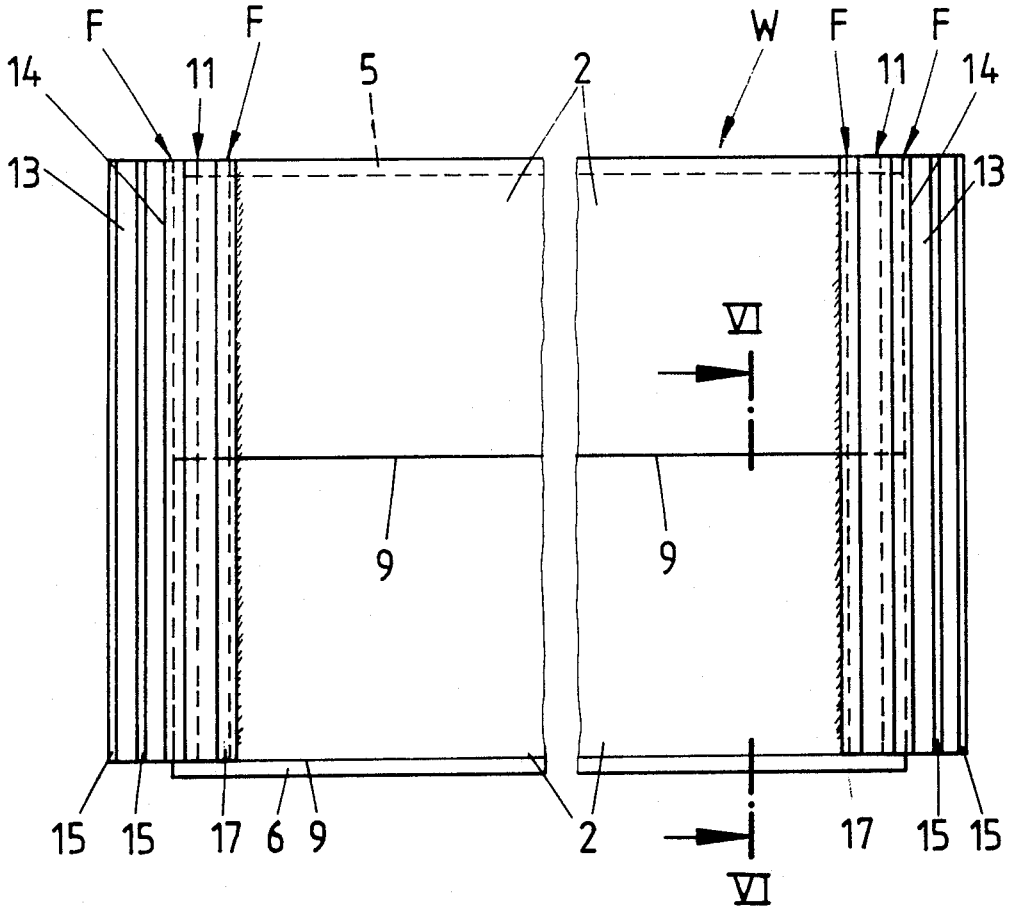
FIG. 4 is a side elevational view of one of the partition walls.
Figure 5:
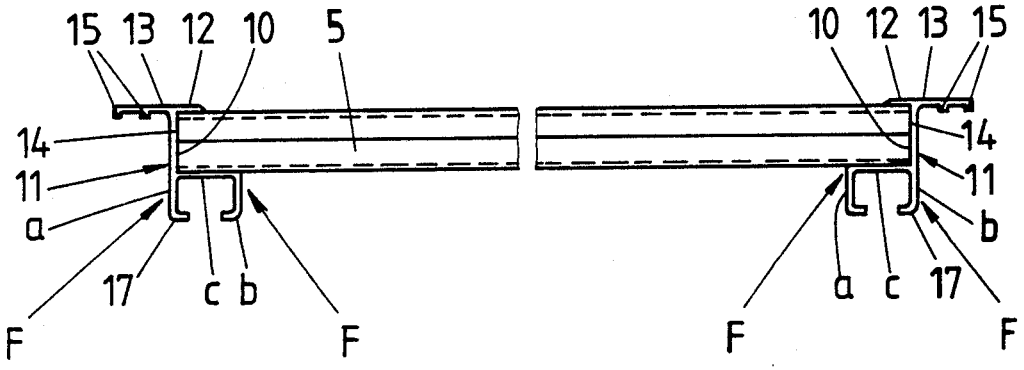
FIG. 5 is a top plan view of the partition wall shown in FIG. 4.

Shoe bars 11 extend the entire length of the vertical transverse edges of partition walls 2 and in effect form vertical junction straps. As shown in FIG. 3, shoe bars 11 have at the side of the wall of the trench a T-shaped foot. The shorter leg 12 forms one boundary of recess 10 and contacts the wall of the trench; the other leg 13 of the T extends in the opposite direction beyond the T-web 14 of the T which is oriented perpendicularly to the wall of the trench. Leg 13 is nearly twice as long as leg 12, and is stiffened by vertical ribs 15 directed away from the wall of the trench.

A flange F, which is a part of shoe bar 11, is formed at the end of web 14 and extends over the surface of partition walls 2 and projects beyond said surface. The braces engage the flanges so that they overlap the surface of the partition wall in such a way that an elongation of the brace axis y-y crosses the partition wall 2.

Flange F is in the form of a U-section 17 having legs a,b which are parallel to each other. Leg b is an extension of the T-web 14. The ends of leg a,b are bent inwardly toward each other to reinforce the U-section. The base c of the U-section together with leg 12 of shoe bar 11 and web 14 form recess 10 for engaging the vertical transverse edges of partition walls 2.

As can be seen from FIG. 3, legs a,b of the U-section 17 are provided with holes 18 for receiving pins 19 to retain shoes 22 of braces 1 in engagement with U-section 17. Fastening holes 18 extend over the entire length of the flange F of shoe bar 11, and they are spaced equally apart. Three such fastening holes 18 are shown for each partition wall 2. A cotter pin 20 is inserted into one end of pins 19 to retain it in hole 18. A gripping handle 21 with a cross section larger than that of the pin 19 is formed on the other end of said pin.

A shoe 22 in the form of a U-shaped section, is secured to the threaded section 1' at both ends of each brace 1. The U-shaped shoe 22 of the brace overlaps the U-legs a and b of the flange F. The U-legs of the shoe 22 of the brace have perforations 22' which are in alignment when shoe 22 is in engagement with the flange F so that the pins 19 lock said assembly together at holes 18.

At greater trench depths, several partition walls can be combined to form a larger trench shoring box unit so that shoring of the walls of the trench is possible down to the bottom of the trench. As shown in FIG. 7, braces 1 are connected to the partition walls through the interposition of coupling bars 25, which extend across separation line 24 of two adjoining partition walls 2. The connection between the braces and coupling bars 25 can best be seen in FIG. 8 wherein the coupling bars 25 engage the flange F. Coupling bars 25 are in the form of H-sections, the web of which separates two opposite directed U-shaped legs 26 and 27. U-leg 26 overlaps the flange F of shoe bar 11, and U-leg 27 is positioned to receive the U-section of brace shoe 22.

Figure 8:
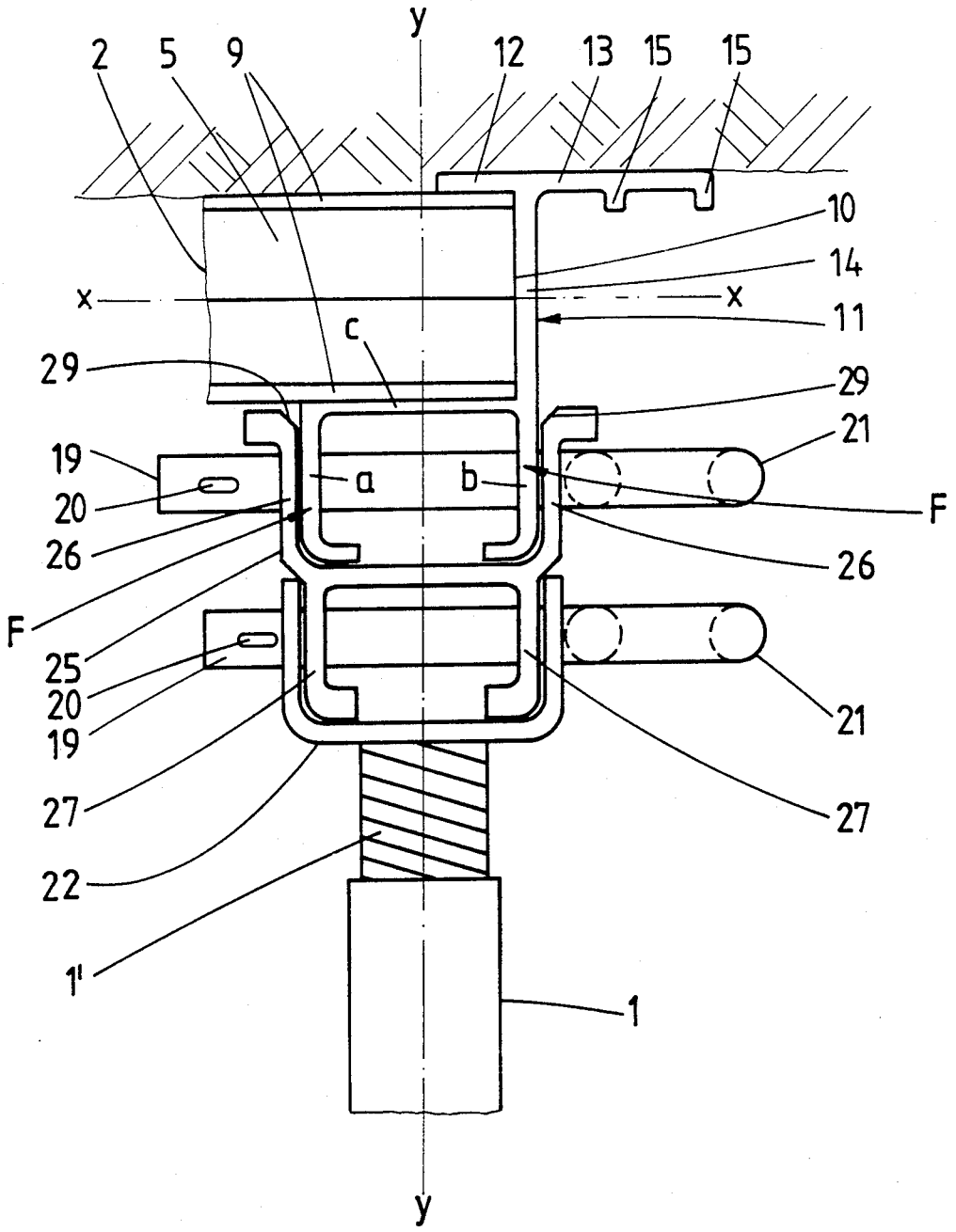
FIG. 8 is an enlarged top plan view of the connection point between brace and one of the coupling bars connecting the partition walls.

U-legs 27 of coupling bar 25 are spaced from each other by the same distance as the spacing of legs 26 on flange F so that one and the same shoe size for the brace shoes 22 can be used. As shown in FIG. 8, legs a, b of flange F are aligned with the corresponding U-legs 27 of the coupling bar 25.

In order to reinforce the outer ends of coupling bar 25, ends of the U-legs 26 are bent outwardly forming the diverging directional flange 29 and the ends of U-flanges 27 are bent inward.

The pin holes of coupling bar 25 have a diameter which corresponds to the diameter of holes 18 in the flange F of the shoe bar 11. The holes in U-legs 27 are spaced in such a way that the brace cannot be connected to the coupling bar 25 at the separation line 24 between two walls.

While only several embodiments of the invention have been shown and described, it will be obvious that other modifications and changes may be made thereunto, without departing from the spirit and scope of the invention.

What is claimed is:

1. A trench shoring box unit for supporting the walls of a trench, comprising:

hollow partition walls positioned opposite to each other, each partition wall having internal support webs;

adjustable length braces disposed between said partition walls;

groove-and-tongue joints formed on the longitudinal edges of each partition wall for interlocking adjacent partition walls;

shoe bars surrounding the vertical edges of said partition walls and secured thereto; and a flange portion formed on said shoe bars inwardly of said partition walls and projecting beyond the surface of said partition wall towards the interior of the trench, said flange portion receiving and engaging the ends of said adjustable length braces, said shoe bars further including a T-shaped strip having a leg portion disposed adjacent to said vertical edge of said partition walls with one end of said leg connected to said flange portion and the other end thereof connected to a crossbar portion of said T-shaped strip thereby forming a U-shaped recess in which said vertical edges of said partition walls are received.

2. The trench shoring box unit as defined in claim 1, wherein the partition walls are formed of aluminum.

3. The trench shoring box unit as defined in claim 1, wherein said flanges overlap the partition walls so that the extension of the axis y-y of said braces crosses the partition wall.

4. The trench shoring box unit as defined in claim 1, wherein the configuration of the groove-and-tongue joint in cross section are "V" shaped with the apex of the "V" being in the longitudinal center plane x-x of said partition wall.

5. The trench shoring box unit as defined in claim 4, wherein the legs of said "V" extends to the inner surfaces of the partition walls and thereafter continues to the outer surfaces to form a shoulder in a plane at right angles to said outer surfaces.

6. A trench shoring box unit comprising:

oppositely arranged hollow partitions, each partition having a pair of aluminum walls having inner support webs;

adjustable length braces disposed between said partitions; and a shoe bar having a flange portion for receiving said braces interior of said partitions whereby the extension of the longitudinal axis of said braces intersects the wall area thereof, said shoe bar including a substantially T-shaped strip, for framing the edge of said walls of said hollow partition and wherein a crossbar of said T-shpaed strip has one leg adapted to embrace an edge of the wall of said partition adjacent the trench wall and the other leg adapted to extend outwardly from said wall edge to be freely exposed on the side of the trench wall.

7. The trench shoring box unit as defined in claim 6, wherein said T-shaped strip has a leg portion forming at least part of said edge of said walls with one end of said leg connected to said flange portion and the other end thereof connected to said crossbar thereby forming a U-shaped recess in which said edges of said partition walls are received.

8. The trench shoring box unit as defined in claim 7, wherein the leg portions of said U-shaped flange have pin receiving openings, and the ends of said braces have U-shaped shoes mating said flanges and have pin receiving openings in alignment with pin receiving openings on said U-shaped flange.

9. The trench shoring box unit as defined in claim 8, wherein coupling bars engage said flanges and extend across the partition line of abutting partition walls, said braces engaging said coupling bars.

10. The trench shoring box unit as defined in claim 9, wherein said coupling bars have a H-shape for engaging said flange on the partition wall and for providing a surface to be engaged by said shoes on the ends of said braces.

11. The trench shoring box unit as defined in claim 6, wherein said adjustable length braces comprise turnbuckles each having reversibly threaded end sections, threadably engaged to a threaded center section.

12. A trench shoring box according to claim 6 wherein said flange portion has a U-shape formed by a pair of legs extending towards the interior of the trench separated by a bridge portion disposed opposite said leg portions of said crossbar of said T-shaped strip and spaced therefrom thereby forming a recess for framing said hollow partition.

* * * * *